US008991520B2

(12) United States Patent
Kulkarni et al.

(10) Patent No.: US 8,991,520 B2
(45) Date of Patent: Mar. 31, 2015

(54) MATHEMATICAL MODELING OF SHALE SWELLING IN WATER BASED MUDS

(75) Inventors: Sandeep D. Kulkarni, Pune (IN); Shadaab S. Maghrabi, Pune (IN); Kushabhau D. Teke, Pune (IN); Dhanashree Gajanan Kulkarni, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 428 days.

(21) Appl. No.: 13/424,696

(22) Filed: Mar. 20, 2012

(65) Prior Publication Data

US 2013/0248251 A1 Sep. 26, 2013

(51) Int. Cl.

| | |
|---|---|
| ***E21B 49/00*** | (2006.01) |
| ***E21B 7/00*** | (2006.01) |
| ***E21B 21/06*** | (2006.01) |

(52) U.S. Cl.

CPC ..... *E21B 21/06* (2013.01)
USPC ..... 175/50; 175/58; 175/64; 175/65

(58) Field of Classification Search

None
See application file for complete search history.

(56) References Cited

FOREIGN PATENT DOCUMENTS

| | | |
|---|---|---|
| EP | 0282231 A2 | 9/1988 |
| EP | 0282231 A3 | 9/1988 |

(Continued)

OTHER PUBLICATIONS

Chenevert, M.E., et al., "Shale/Mud Inhibition Defined with Rig-Site Methods," Sep. 1989, pp. 261-268, SPE Drilling Engineering.

(Continued)

*Primary Examiner* — Zakiya W Bates

(57) ABSTRACT

A method of servicing a wellbore comprises determining a cation exchange capacity of a sample of a shale, determining a swelling characteristic of the shale using the cation exchange capacity in an equation comprising a term of the form:

$$A_{z\ \%\ salt}=x(\text{cation exchange capacity})^y$$

where $A_{z\ \%\ salt}$ is a final swelling volume of the shale in the presence of an aqueous fluid having a salt concentration of z %, and x and y are empirical constants, determining a composition of a wellbore servicing fluid based on the determined swelling characteristic, and drilling the wellbore using the wellbore servicing fluid. The swelling characteristic of the shale can be determined using the cation exchange capacity of the shale and a salt concentration in an equation comprising a term of the form:

$$A_{m\ \%\ salt}=f(m,z)*(x)(\text{cation exchange capacity})^y$$

where $A_{m\ \%\ salt}$ is a final swelling volume of the shale in contact with an aqueous fluid having a salt concentration of m %, f(m,z) is a function based on the salt concentration of m % relative to salt concentration of z % in the aqueous fluid in contact with the shale, and x and y are empirical constants defining the relation $A_{z\ \%\ salt}$=x (cation exchange capacity)$^y$.

18 Claims, 3 Drawing Sheets

(56) References Cited

FOREIGN PATENT DOCUMENTS

| | | | |
|---|---|---|---|
| GB | 2217021 | A | 10/1989 |
| WO | 2013141963 | A2 | 9/2013 |

OTHER PUBLICATIONS

Fitch, Alanah, et al., "Effect of Clay Charge on Swelling: A Clay-Modified Electrode Study," 1995, pp. 607-614, vol. 43, No. 5, Clay and Clay Minerals.

Rabe, C., et al., "Laboratory Characterization of Norwegian North Sea Shale," 2008, pp. 459-466, ISRM International Symposium.

ANSI/API Recommended Practice 13B-1 entitled "Recommended Practice for Field Testing Water-based Drilling Fluids" dated Mar. 2009, 104 Pages, Fourth Edition, American Petroleum Institute.

Foreign communication from a related counterpart application—Invitation to Pay Additional Fees, PCT/US2013/024086, Aug. 13, 2013, 7 pages.

Hill, Donald G., "Clay Stabilization—Criteria for Best Performance," SPE 10656, XP-055073184, 1982, pp. 127-138, Society of Petroleum Engineers of AIME.

Önal, Mü§erref, "Swelling and cation exchange capacity relationship for the samples obtained from a bentonite by acid activations and heat treatments," XP-022100940, Applied Clay Science, 2007, vol. 37, pp. 74-80, Elsevier B.V.

Yilmaz, I§ik, "Indirect estimation of the swelling percent and a new classification of soils depending on liquid limit and cation exchange capacity," XP-028028662, Engineering Geology, 2006, vol. 85, pp. 295-301, Elsevier B.V.

MATHEMATICAL MODELING OF SHALE SWELLING IN WATER BASED MUDS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. The formation materials encountered while drilling into a subterranean formation can vary widely depending on the location and depth of the desired reservoir. One commonly encountered material is shale, which is generally comprised of various clays. Shale hydration, commonly seen when ordinary water-based fluids are used in water-sensitive formations, can be a significant cause of wellbore instability. Further, the clays forming the shales also tend to adhere to the drill bit or to the bottomhole assembly, severely impairing the rate of penetration during drilling. In some worst case scenarios, failure to remove hydratable clay from the wellbore can lead to gumbo attacks, packing off, lost circulation, and/or stuck pipe.

One common solution used to prevent the shale interaction with water is to use an oil-based drilling fluid, such as an invert emulsion fluid. These fluids have generally performed well as drilling fluid for water-sensitive formation such as those containing shales. However, oil-based drilling fluids can be expensive and less environment friendly when compared to water-based or aqueous based drilling fluids.

SUMMARY

In an embodiment, a method of servicing a wellbore comprises determining a cation exchange capacity of a sample of a shale, determining a swelling characteristic of the shale using the cation exchange capacity in an equation comprising a term of the form:

$$A_{z\ \%\ salt}=x(\text{cation exchange capacity})^{y}$$

where Az % salt is a final swelling volume of the shale in the presence of an aqueous fluid having a salt concentration of z %, and x and y are empirical constants, determining a composition of a wellbore servicing fluid based on the determined swelling characteristic, and drilling the wellbore using the wellbore servicing fluid. The shale may comprise a clay, and the clay may comprise a smectite clay, an illite clay, a mixed smectite-illite clay, a chlorite clay, a corrensite clay, a kaolinite clay, or any combination thereof. The wellbore servicing fluid may be a water-based wellbore fluid that comprises an aqueous fluid, and the wellbore servicing fluid may also comprises at least one salt. The wellbore servicing fluid may further comprise one or more additives selected from the group consisting of: an emulsifier, a viscosifier, an emulsion destabilizer, an antifreeze agent, a biocide, an algaecide, a pH control additive, an oxygen scavenger, a clay stabilizer, a weighting agent, a degradable fluid loss agent, a foaming agent, a foaming fluid, and any combination thereof. Determining the cation exchange capacity of the sample may comprise performing a test using a methylene blue method, an ammonium acetate method, a benzyl ammonium chloride method, a malachite green method, or a silver-thiourea method. The empirical constant x may have a value in the range of about 0 and about 20, and y may have a value in the range of about 0 and about 6. In an embodiment, the empirical constant x is about 0.65 and y is about 1.1 when the z % salt concentration is about 24% sodium chloride. Determining the composition of the wellbore servicing fluid may comprise selecting one or more components of the wellbore servicing fluid to maintain the swelling characteristic of the shale within a selected range.

In an embodiment, a method of servicing a wellbore comprises drilling a first portion of a wellbore through a subterranean formation using a first drilling fluid, wherein the subterranean formation comprises a shale, adjusting a concentration of a salt in the first drilling fluid to produce a second drilling fluid based on a swelling characteristic of the shale, wherein the swelling characteristic of the shale is determined using a cation exchange capacity of the shale, and drilling a second portion of the wellbore using the second drilling fluid. The salt may comprise at least one compound selected from the group consisting of: sodium chloride (NaCl), potassium chloride (KCl), calcium chloride ($CaCl_2$), a magnesium salt, a bromide salt, a formate salt, an acetate salt, a nitrate salt, and any combination thereof. The cation exchange capacity of the shale may be determined using a methylene blue method, an ammonium acetate method, a benzyl ammonium chloride method, a malachite green method, or a silver-thiourea method. The swelling characteristic of the shale may be determined using the cation exchange capacity of the shale and a salt concentration in an equation comprising a term of the form:

$$A_{m\ \%\ salt}=f(m,z)*(x)(\text{cation exchange capacity})^{y}$$

where $A_{m\ \%\ salt}$ is a final swelling volume of the shale in contact with an aqueous fluid having a salt concentration of m %, f(m,z) is a function based on the salt concentration of m % relative to salt concentration of z % in the aqueous fluid in contact with the shale, and x and y are empirical constants defining the relation $A_{z\ \%\ salt}=x(\text{cation exchange capacity})^{y}$. Adjusting the concentration of the salt of the first drilling fluid may comprise adjusting the concentration of the salt in an aqueous fluid to maintain the swelling characteristic of the shale within a selected range. Adjusting the concentration of the salt of the first drilling fluid may comprise selecting a composition of the salt to maintain the swelling characteristic of the shale within a selected range.

In an embodiment, a method of predicting the swelling of a shale comprises determining a model of a swelling characteristic of one or more first shale samples as a function of a cation exchange capacity corresponding to each of the one or more first shale samples, determining a second cation exchange capacity of a second shale sample, and predicting a swelling characteristic of the second shale sample using the model and the second cation exchange capacity of the second shale sample. The model may comprise a power function, an exponential function, a polynomial function, a linear function, or a combination of the functions. The model may have an $R^2$ value of greater than 0.9 when comparing one or more predicted swelling values to a corresponding number of actual swelling values for the one or more first shale samples. The model may have a root mean square error value of less than about 10.0 percent when comparing one or more predicted swelling values to a corresponding number of actual swelling values for the one or more first shale samples. The model may comprise an equation of the form:

$$A_{z\ \%\ salt}=x(\text{cation exchange capacity})^y$$

where $A_{z\ \%\ salt}$ is a final swelling volume of the shale in the presence of an aqueous fluid having a salt concentration of z %, and x and y are empirical constants. The empirical constant x may have a value in the range of about 0.0 and about 20.0, and y may have a value in the range of about 0.0 and about 6.0. Determining the model of the swelling characteristic of the one or more first shale samples further may comprise determining the model of the swelling characteristic of the one or more first shale samples as a function of a salt concentration of an aqueous fluid in contact with the one or more first shale samples. The model may comprise an equation of the form:

$$A_{m\ \%\ salt}=f(m,z)*A_{z\ \%\ salt}$$

where $A_{m\ \%\ salt}$ is the final swelling volume of a shale in contact with an aqueous fluid having a concentration of a salt of m %, $A_{z\ \%\ salt}$ is a final swelling volume of the shale in contact with an aqueous fluid having a concentration of salt of z %, and f(m,z) is a function or constant based on the concentration of the salt of m % in the aqueous fluid relative to salt concentration of z % in contact with the shale. Determining the model of a swelling characteristic may comprise determining a cation exchange capacity for each of the one or more first shale samples, and wherein determining the cation exchange capacity comprises performing a test using a methylene blue method, an ammonium acetate method, a benzyl ammonium chloride method, a malachite green method, or a silver-thiourea method. Determining the model of a swelling characteristic may comprise determining a swelling volume for each of the one or more first shale samples, and wherein determining the swelling volume comprises performing at least one of a linear swell meter test, a capillary suction test, or a hardness test.

In an embodiment, a method of drilling a wellbore comprises drilling a wellbore in a subterranean formation comprising a shale, ceasing the drilling in response to encountering an operational issue, determining a swelling characteristic of the shale based on a cation exchange capacity of the shale, determining a solution to the operational issue based on the swelling characteristic, and continuing the drilling in response to applying the solution to the operational issue.

In an embodiment, a method of drilling a wellbore comprises measuring at least one parameter of a drilling process while drilling a wellbore in a subterranean formation comprising a shale, determining a swelling characteristic of the shale in response to the at least one parameter exceeding a threshold, wherein the swelling characteristic is determined based on a cation exchange capacity of the shale and a concentration of salt in a drilling fluid, modifying a composition of the drilling fluid based on the determined swelling characteristic, and continuing to drill the wellbore using the drilling fluid having the modified composition.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
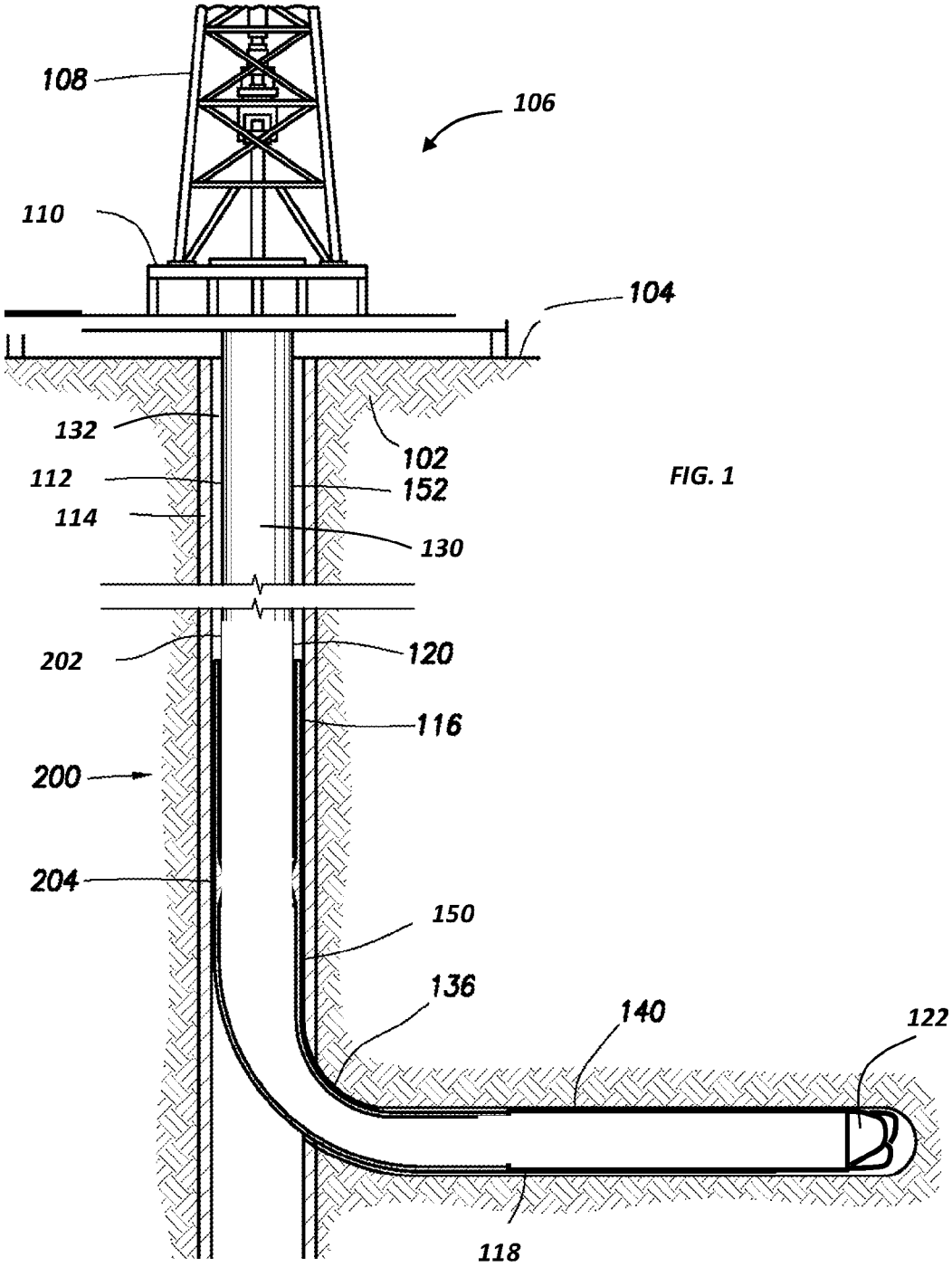
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center of the wellbore in a radial direction (i.e., towards the central axis of the wellbore and/or the limit collar) and with "out," "outer," or "outward" meaning towards the wall of the well in a radial direction, regardless of the wellbore orientation. As used herein, a "servicing fluid" refers to a fluid used to drill, complete, work over, fracture, repair, abandon, and/or in any way treat a wellbore residing in a subterranean formation penetrated by the wellbore. Examples of servicing fluids include, but are not limited to, drilling fluids or muds, spacer fluids, fracturing fluids, completion fluids, remedial fluids, workover fluids, and/or treatment pills. The various characteristics mentioned above, as well as other features and characteristics described in more detail below, will be readily apparent to those skilled in the art with the aid of this disclosure upon reading the following detailed description of the embodiments, and by referring to the accompanying drawings.

As described in more detail herein, a model for predicting a swelling characteristic of a shale may be developed and used for various purposes while drilling a wellbore and/or performing a workover procedure (e.g., fracturing) during the life of a wellbore. The model may be based, at least in part, on the cation exchange capacity of a shale or particular shale sample. In general, the cation exchange capacity can be quickly assessed at the well site, thereby allowing for a quick determination of the swelling characteristics of a shale. This determination may be used to adjust various operating parameters, adjust a wellbore servicing fluid composition, address one or more operational issues while drilling and/or performing a workover procedure, and/or identify potential operational issues before they happen.

Referring to FIG. 1, an example of a wellbore operating environment is shown. As depicted, the operating environment comprises a drilling rig 106 that is positioned on the earth's surface 104 and extends over and around a wellbore 112 that penetrates a subterranean formation 102 for the purpose of recovering hydrocarbons. The wellbore 114 may be drilled into the subterranean formation 102 using any suitable drilling technique. The resulting wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further the wellbore may be used for both producing wells and injection wells.

The drilling rig 106 comprises a derrick 108 with a rig floor 110 through which the drill string 120 extends downward from the drilling rig 106 into the wellbore 114. In an embodiment, the drill string 120 comprises a drill collar and is disposed within the wellbore 114. A drill bit 122 is located at the lower end of the drill string 120 and carves the wellbore 114 through the subterranean formation 102. The drill bit 122 may be one or more bits. The drilling rig 106 comprises a motor driven winch and other associated equipment for extending the drill string 120 into the wellbore 114 to position the drill string 120 for drilling the wellbore 114. While the operating environment depicted in FIG. 1 refers to a stationary drilling rig 106 for lowering and setting the drill string 120 within a land-based wellbore 114, in alternative embodiments, mobile workover rigs, wellbore servicing units (such as coiled tubing units), and the like may be used to lower the drill string 120 into a wellbore. It should be understood that a drill string 120 may alternatively be used in other operational environments, such as within an offshore wellbore operational environment.

In an embodiment, the drill string 120 may also comprise one or more instruments and/or instrument subs for measuring various parameters during the drilling process. Common measurements obtained during drilling may include weight-on-bit, torque-on-bit, rate-of-penetration, temperature, and/or pressure near the bit. Additional measurements may include the torque on the drill string 120, the power output of any motors and/or pumps located at the surface of the wellbore, and the like. The drill string may also include one or more logging tools for measuring one or more properties of the subterranean formation 102 and/or the drilling fluid. The measurements from any of these instruments, sensors, and/or logging tools may be used to adjust one or more drilling process parameters and/or a drilling fluid composition.

In an embodiment, a drilling fluid is pumped from a storage reservoir pit near the wellhead, down an axial passageway 130, through the drill string 120, and out of apertures in the drill bit 122. As used herein, the "drilling fluid" may also be referred to as a "drilling mud." The drilling fluid is pumped from the storage pit near the well head by a pumping system comprising one or more pumps. The drilling fluid may travel through a drilling fluid supply line coupled to the central passageway 130 extending throughout the length of the drill string 120. The annular region 132 between the drill string 120 and the sidewalls of the wellbore 114 forms the return flow path for the drilling fluid. Drilling fluid is, in this manner, forced down the drill string 120 and exits into the borehole through apertures in the drill bit 122 for cooling and lubricating the drill bit and carrying the formation cuttings produced during the drilling operation back to the surface. A fluid exhaust conduit may be connected from the annular region 132 at the well head for conducting the return drilling fluid flow from the wellbore 114 to the storage pit. The drilling fluid may be handled and treated by various apparatus, comprising out gassing units and circulation tanks for maintaining a preselected mud viscosity and consistency. The cuttings produced by the drill bit 122 cutting the subterranean formation 102 may be carried with the returned drilling fluid. The cuttings may be removed at various points including the storage pit and/or a shaker designed to allow the drilling fluid to pass through while retaining the cuttings for disposal. These cuttings may comprise one source of the cuttings samples analyzed according to the methods disclosed herein.

The embodiment shown in FIG. 1 may also be used to dispose and/or set one or more casing strings within the wellbore 114 to thereby form one or more cased sections of the wellbore 114. In the embodiment shown in FIG. 1, the casing string may be conveyed into the subterranean formation 102 in a conventional manner (e.g., using the same motor driven winch and other associated equipment used to extend the drill string 120 into the wellbore 114) and may subsequently be secured within the wellbore 114 by filling an annulus 112 between the casing string and the wellbore 114 with cement. The drilling of the wellbore 114 may then proceed by passing the drill string 120 through the cased section of the wellbore 114. In alternative operating environments, a vertical, deviated, or horizontal wellbore portion may be drilled, cased, and cemented and/or portions of the wellbore may be left uncased. For example, uncased and drilled section 140 may comprise a section of the wellbore 114 ready for being cased with a wellbore tubular and/or ready for production.

In an embodiment, a wellbore may be drilled through a subterranean formation comprising a shale. Shale is a fine-grained, clastic sedimentary rock composed of a mix of clay minerals and fragments of other minerals such as quartz, calcite, pyrite, chlorite, feldspar, opal, cristobalite, biotite, clinoptilite, gypsum, and the like. The ratio of clay to the other minerals may vary depending on the source of the shale. In an embodiment, the clay present in the shale can comprise a smectite, illite, mixed smectite-illite layer, chlorite, corrensite, kaolinite clay, and/or any combination thereof. As an example, a smectite clay may be sodium bentonite that may contain sodium in addition to the components magnesium, aluminum and silica. Additional species of smectite clay include hectorite, saponite, nontronite, beidellite, and/or sauconite.

The crystal structure of the clay present in the shale may allow the clay to swell in the presence of an aqueous fluid. For example, the crystal structure of smectite clay species, including bentonite, may constitute a three-layer sheet structure. The upper and lower layers of the sheet structure may be silica with the middle plate being a metal layer comprising a plurality of the metals aluminum, iron, lithium, manganese and magnesium. The interlayer space may contain sodium or calcium. The morphology of any species of smectite clay may constitute a stacked plate structure of the three-layer sheets.

For a wellbore being drilled through a shale and/or an open hole being contacted with a wellbore servicing fluid comprising water, any water and/or ions present may diffuse into the shale. The water is generally attracted to the clays in the shale and may be drawn into the shale by the diffusion process. The first stage of hydration, can cause the shale to expand into the wellbore and cause excessive circulating pressures, lost circulation, and/or stuck drill collars. Water content may increase in the shale near the wall of the wellbore and between the clay platelets, expanding from about three to about five layers. As the platelets absorb the water, their suction pressure diminishes toward equilibrium. Further from the wall of the wellbore, any water present may not have hydrated the clay. As the clays absorb an increasing amount of water, the shale stresses may increase until failure of the shale occurs, resulting in caving of the shale surrounding the borehole, wellbore enlargement, and/or a number of additional associated operational issues (e.g., sloughing of the shale, a tight hole, bore hole collapse, stuck-pipe, stuck collars, gumbo attacks, poor hole cleaning, poor logging and cementing conditions, difficulty returning a drilling and/or production assembly to the bottom of the wellbore, and/or disintegration of the shale that can lead to an increase in the concentration fines, a change in the rheological properties, and the rate of penetration). Upon further hydration, the clay particles may be dispersed into the fluid, thereby leaving the shale as dispersed solids in the wellbore servicing fluid.

As described above with reference to FIG. 1, a wellbore may be drilled using a water-based wellbore servicing fluid such as a drilling fluid. The water-based wellbore servicing fluid suitable for use in the present invention comprise an aqueous fluid and one or more additives and/or modifiers for use with water-based wellbore servicing fluids (e.g., water-based muds, completion fluids, etc.). The aqueous fluids that may be used in the aqueous based wellbore servicing fluids may include fresh water, salt water, brine, seawater, and/or any other aqueous fluid that does not adversely react with the other components used in the water-based wellbore servicing fluid and/or the subterranean formation. A commonly used aqueous fluid comprises sea water and/or brine.

Various salts may be present in the aqueous fluid used with the aqueous based wellbore servicing fluid. The salts may comprise naturally occurring salts, such as sodium chloride (NaCl), found in the aqueous fluid source (e.g., seawater), and/or additional salts that may be added. In an embodiment, the aqueous fluid may comprise a salt including, but not limited to, sodium chloride (NaCl), potassium chloride (KCl), calcium chloride ($CaCl_2$), magnesium salts (e.g., $MgCl_2$), various bromide salts (e.g., NaBr, KBr, $CaBr_2$ etc.), formate salts (e.g. NaCOOH, KCOOH), acetate salts, nitrate salts, and any combinations thereof. The salts may be present in the aqueous fluid at any concentration of about zero (e.g., substantially 0% on a weight basis) to about a saturated concentration in the aqueous fluid at the conditions at the wellsite and/or within the subterranean formation. In some embodiments, additional salt may be added to a wellbore servicing fluid beyond its saturation concentration to allow the solid salt to be used for various purposes. For example, one or more salts may be added to a wellbore servicing fluid to act as a bridging agent during the drilling of a wellbore.

The aqueous based wellbore servicing fluid may also comprise one or more additional additives and/or modifiers for use with water-based wellbore servicing fluids. Suitable additives and/or modifiers may include, but are not limited to, emulsifiers, viscosifiers, emulsion destabilizers, antifreeze agents, biocides, algaecides, pH control additives, oxygen scavengers, clay stabilizers, weighting agents, degradable fluid loss agents, foaming agents, foaming fluids (e.g., gases), and the like or any other additive that does not adversely affect the aqueous based wellbore servicing fluid. One of ordinary skill in the art with the benefit of this disclosure will recognize that the compatibility of any given additive should be tested to ensure that it does not adversely affect the performance of the aqueous based wellbore servicing fluid or any other desired additive.

The shale present in the subterranean formation may swell in the presence of the water-based wellbore servicing fluid, leading to various problems such as sloughing of the shale, bore hole collapse, stuck-pipe, gumbo attacks, and/or disintegration of the shale that can lead to an increase in the concentration fines, a change in the rheological properties, and/or the rate of penetration. The shale characteristics may be determined and/or predicted based on tests of the shale from the wellbore being drilled or other shale samples to determine the shale properties. For example, various tests used to determine shale properties can include a Linear Swell Meter (LSM) test, a shale erosion test, a slake durability test, a capillary suction test, a hardness test, and/or any combination thereof. Suitable swelling characteristic determination methods include those described in "Shale/Mud Inhibition Defined With Rig-Site Methods," SPE Drilling Engineering, Chenevert et al. (September 1989), which is incorporated by reference herein in its entirety. The LSM test may be used to determine and/or represent the swelling characteristic of the shale. On the other hand, the shale erosion test and slake durability test may account for both swelling of the shale as well as disintegration of shales under fluid motion. However, these tests can be time consuming, with some tests taking a day or more to obtain useful results. Rather than test a shale sample each time the shale properties are desired, it has been discovered that the swelling characteristics of the shale may be modeled through a consideration of the Cation Exchange Capacity ("CEC") of the shale. While not intending to be limited by theory, it is believed that the swelling of a shale also depends, at least in part, on the salt concentration of the aqueous fluid in contact with the shale. As a result, the modeling of the shale swelling may also take the salt composition and/or concentration of the water-based wellbore servicing fluid in contact with the shale into account. The results of the modeling may then be used to determine and/or alter the composition of a water-based wellbore servicing fluid used to drill and/or complete a wellbore, where the determination may be carried out without having to perform a new swelling characteristics test on a sample of shale.

In the broadest sense, a model for the swelling characteristics of a shale may be determined at a given salt concentration and/or composition as a function of the CEC of one or more shale samples. The model may then be used to predict the swelling characteristics of another shale sample by determining the CEC of that shale and using it with the model. An adjustment may be made to the model to account for difference between the salt concentration of the fluid used to determine the model and a desired salt concentration of a fluid in contact with the shale. Various swelling characteristics may be modeled using the model including the swelling volume, the swelling volume percentage, the swelling at a specified contact time, and/or the rate of swelling of the shale. In an embodiment, a model for the swelling characteristics of the shale may be developed using an empirical analysis of the swelling of a shale having a measured CEC in the presence of an aqueous fluid with a known or determinable salt concentration. The clay in the shale generally expands in all directions when exposed to an aqueous fluid, and is generally expressed as a volume percentage increase. When contacted with an aqueous fluid, the clay in the shale tends to expand over a time period ranging from several minutes to several days or weeks depending, at least in part, on the rate of diffusion of the water into the shale. Various parameters may affect the rate of swelling of the shale including, but not limited to, temperature, pressure, composition of the shale, and/or the composition of the aqueous fluid in contact with the shale. While the rate of swelling may vary between various shales, it has been determined that the predominant factors affecting the final swelling volume are the CEC of the shale and the salt concentration of the aqueous fluid in contact with the shale. As used herein, the term "final swelling volume" refers to the term:

$$\text{final swelling volume} = \left(\frac{\text{final shale volume} - \text{initial shale volume}}{\text{initial shale volume}} * 100\right) \quad \text{(Eq. 1)}$$

where final shale volume is obtained when the shale is allowed to substantially fully equilibrate with a specified fluid, or any value within about 10% of the swelling volume of the shale that is substantially fully equilibrated with a specified fluid, which can account for the expected experimental error in the final swelling volume. The final swelling volume may depend, at least in part, on the temperature and pressure of the sample. As described in more detail herein, a selected temperature and pressure may be used with the LSM test to reduce any variances in the final swelling volume resulting from changes in temperature and pressure of the sample. In an embodiment, one or more models and/or correction factors may be used to adjust for differences in the temperature and pressures at which the final swelling volume of different samples may be obtained. Any suitable test capable of measuring the swelling characteristics of a sample of shale when exposed to an aqueous fluid may be used to determine the extent of swelling of a given sample due to the exposure of the sample to an aqueous fluid.

The model for predicting the swelling characteristics of the shale may be developed based on shale samples from a variety of locations. The shale samples may be obtained from a specific wellbore using, for example, core samples from an exploratory well, production well, or a well being drilled. The shale samples may also be obtained from the cuttings present in the returns of a well being drilled. For example, the cuttings may be obtained from the shaker as described with respect to FIG. 1. Alternatively, shale samples from wellbores close to the wellbore of interest may be used. These may include wellbores that have been drilled or are being drilled into the same subterranean formation as a wellbore of interest, and/or wellbores associated with the same geological formations. In some embodiments, various shale samples from diverse locations may be used. This may allow for shale samples from the diverse locations to be used in determining the model for predicting the swelling characteristics of the shale.

In an embodiment, a LSM test may be used to measure the swelling characteristics of the shale. The LSM test determines the swelling of a sample of shale within a laterally confined space, to produce a substantially linear swelling of the shale sample. This linear swelling measurement may then be used to determine the percentage of volume increase and/or decrease of the shale sample due to the exposure of the sample to an aqueous fluid.

In an embodiment, the LSM test may use a shale sample that is first dried and ground to a desired size. The sample may generally be ground to a size permitting the particles to pass through a 100-mesh screen, a 200-mesh screen, or alternatively, a 300-mesh screen (based on the U.S. mesh scale). In an embodiment, the sample may be ground to pass through a 200-mesh screen. The ground and screened sample may be dried and homogenized with a measured amount of water. The sample may be dried at a temperature ranging from about 100° F. to about 300° F., or alternatively about 220° F. The measured amount of water added at this stage may be sufficient to provide a moisture content in the sample ranging from about 1% to about 10% by weight, or alternatively about 5% by weight. At least a portion of the homogenized sample is then placed in a mold, which in an embodiment, may be generally cylindrical. A compacting pressure may be applied and maintained to produce a representative sample with a desired shape. In an embodiment, a compacting pressure of at least about 100 pounds per square inch ("psi"), at least about 1,000 psi, at least about 5,000 psi, at least about 10,000 psi, or alternatively at least about 15,000 psi may be applied to the sample in the mold. In an embodiment, the compacting pressure may be about 10,000 psi. The compacting pressure may be maintained for a time period of at least about 10 minutes, at least about 30 minutes, at least about 60 minutes, at least about 1.5 hours, at least about 3 hours, or at least about 6 hours. In an embodiment, the compaction pressure may be maintained for about 1.5 hours. The resulting compacted shale sample may then be equilibrated in a predetermined constant relative humidity environment, which may use one or more desiccants (e.g., anhydrous calcium chloride). In an embodiment, the environment may have a relative humidity ranging from about 29% to about 35%. The compacted shale sample may be equilibrated for a period ranging from about 1 hour to about 72 hours, or alternatively about 48 hours. The equilibration process may take place within the mold, and/or the compacted shale sample may be removed from the mold to equilibrate. The resulting compressed sample may be referred to as a sample core.

The sample core may then be placed in a LSM test apparatus. The test apparatus comprises a porous sleeve (e.g., a 60-mesh stainless steel (SS) porous sleeve) sized to allow the sample core to be placed within the sleeve; the sleeve generally prevents radial swelling of the sample when exposed to an aqueous fluid, and rather may confine the expansion of the sample core to a linear expansion along the axial direction of the porous sleeve. A base plate may be placed in contact with a first end of the sample core to limit the linear expansion in the direction of the first end of the sample. The base plate may be formed from any suitable material including a metal, polymeric material, etc. In an embodiment, the base plate may be formed from acrylic to permit viewing of the sample in the mold. A plunger may be placed in contact with the second end of the sample core. The plunger may provide a substantially sealing engagement with the inner surface of the porous sleeve while allowing the plunger to move in an axial direction within the porous sleeve.

The assembly may then be placed in a temperature controlled container where the porous sleeve may be exposed to an aqueous fluid, such as a water-based wellbore servicing fluid. The fluid and the test assembly may be maintained at a specified temperature in the range of about 50° F. to about 200° F., about 100° F. to about 175° F., or about 125° F. to about 160° F. In an embodiment, the test assembly is maintained at about 150° F. Higher temperatures up to about 250° F., about 300° F., about 350° F., or about 400° F. may be used with the test assembly when used with a suitable pressure for maintaining the fluid in a liquid state. In an embodiment, the temperature may be maintained at a representative temperature of the formation of interest. The swelling of the sample core may be measured by recording the axial position of the plunger within the porous sleeve. The volumetric increase of the sample core may be determined based on the geometry of the porous sleeve and the axial translation of the plunger. The movement of the plunger may be measured at specified intervals either manually or using an automated sensor coupled to the plunger. In an embodiment, a sensor may be coupled to the plunger and a recording apparatus to store the plunger translation at specified time intervals. The volumetric change in the sample core may be measured over a time period of at least about 1 hour, at least about 6 hours, at least about 12 hours, at least about 18 hours, at least about 24 hours, at least about 36 hours, at least about 48 hours, or at least about 60 hours. The rate of swelling of the shale may generally slow as the swelling approaches its final swelling volume. In an embodiment, the LSM test may be carried out to measure the swelling of the shale until the sample core has substantially reached its final swelling volume. In an embodiment, the LSM test may be carried out to measure the swelling of the shale for about 48 hours. The final swelling volume as determined by the LSM test may then be used in the model to predict the swelling characteristics of the shale as described in more detail herein.

As discussed above, it is believed that the predominant factors affecting the final swelling volume of a shale at a selected temperature and pressure are the CEC of the shale and the salt concentration of the aqueous fluid in contact with the shale. In order to develop the model to predict the swelling characteristics of the shale, the CEC of a shale sample that is tested is also determined. The CEC is defined as the quantity of exchangeable cations required to balance the charge deficiency of a clay particle. In general, larger CEC values indicate shales and/or clays that can expand to a greater degree than those shales and/or clays have smaller CEC values. Various methods are available for determining the CEC of a shale sample, and any of the available methods may be used to determine the CEC of a shale sample. In an embodiment, the method of determining the CEC of a shale sample may include, but is not limited to, the methylene blue method, the benzyl trimethyl ammonium method, the ammonium acetate method, the benzyl ammonium chloride method, the malachite green method, and/or the silver-thiourea method. Each method may produce characteristic results, and the model for the swelling characteristics of a shale may use a single CEC determination method to produce consistent results between different shale samples. Each of these methods may be performed in a relatively short time frame relative to the determination of the swelling characteristics of the shale. For example, the CEC determination may be carried out in less than about 1 hour, about 2 hours, or about 3 hours as compared to the determination of the swelling characteristics of a shale sample which can take about 2 days or longer. Further, the CEC determination may be performed at a wellsite while a determination of the swelling characteristics is often carried out in a more controlled laboratory environment, thereby requiring more time for the transportation of the shale samples to an offsite location for testing. Thus, the ability to predict the swelling characteristics of a shale sample using a model based on a determination of the CEC of a shale sample can reduce the testing time required for adjusting one or more parameters of a wellbore servicing fluid the drilling process, and/or the completion process.

In an embodiment, the CEC of a shale sample may be determined using the methylene blue method. The methylene blue method is described in API Recommended Practice, 13 B (IV Ed., March 2009), which is incorporated herein by reference. In this method, a shale sample is first dried and ground to a desired size. The sample may generally be ground to a size permitting the particles to pass through a 100-mesh screen, a 200-mesh screen, or alternatively, a 300-mesh screen (based on the U.S. mesh scale). In an embodiment, the sample may be ground to pass through a 200-mesh screen. The sample may be dried at a temperature of about 220° F. or greater for a period of greater than about one hour, two hours, three hours, or four hours. In an embodiment, the sample is dried at about 220° F. for a period of greater than about 2 hours. The dried and ground sample is treated with a dispersant and an oxidizing agent. In an embodiment, the dispersant may comprise tetrasodium pyrophosphate, and the oxidizing agents may comprise hydrogen peroxide, sulphuric acid, and any combination thereof. The resulting slurry is then titrated while being agitated with a methylene blue solution. The methylene blue acts as a dye that reacts with the clay in the shale sample until the sample is saturated. The additional of the methylene blue beyond the saturation point results in the appearance of a blue halo when the titration drop is placed on the filter paper, which serves to denote the saturation point of the shale sample. The concentration and volume of the methylene blue solution titrated in the sample may be used along with the properties of the shale sample (e.g., mass, density, etc.) to determine the CEC of the shale sample. The CEC of a shale sample can be expressed in a variety of units including milliequivalents per 100 grams of the sample ("meq/100 g").

In another embodiment, the CEC of a shale sample may be determined using the benzyl trimethyl ammonium method. The benzyl trimethyl ammonium utilizes a solution of benzyl trimethyl ammonium chloride to displace exchangeable ions (e.g., calcium, magnesium, potassium, and/or sodium) from the clay, and then determine the concentration of these ions using any of a variety of techniques such as an inductively coupled argon plasma spectrometry (ICP) analysis. In this method, a shale sample is first dried and ground to a desired size. The sample may generally be ground to a size permitting the particles to pass through a 100-mesh screen, a 200-mesh screen, or alternatively, a 300-mesh screen (based on the U.S. mesh scale). In an embodiment, the sample may be ground to pass through a 200-mesh screen. The sample may then be contacted with a solution containing benzyl trimethyl ammonium chloride. In an embodiment, a shale sample of about 10.0 grams may be combined with about 100 milliliters of a benzyl trimethyl ammonium chloride solution (e.g., an about 6% benzyl trimethyl ammonium chloride solution). The resulting slurry may be mixed and filtered into another container through filter paper (e.g., Whatman 42 filter paper with pulp) to remove the solids. The resulting solution that passes through the filter may then be analyzed to determine the exchangeable ion concentration. In an embodiment, the solution may be diluted prior to the analysis (e.g., diluted to an abut 1:10 mixture). The exchangeable ion concentration may then be determined and converted to appropriate values for use with the methods and models described herein. The benzyl trimethyl ammonium method may provide an indication of both the CEC value for a shale sample and the specific ions present in the shale sample that can be displaced.

A model may be developed to relate the swelling characteristics of the shale sample and the CEC values of the shale sample. In an embodiment, the model may be based on a single or a plurality of samples of a given shale, where a plurality of samples may allow for statistical averaging. The model may be based on a single swelling characteristic determination or a plurality of swelling characteristic determinations. In general, a corresponding number of CEC value determinations may be performed based on the number of swelling characteristic determinations. However, the same or different number of CEC value determinations and swelling characteristic determinations may be performed for one or more—samples of the given shale. For example, a plurality of CEC value determinations may be performed and the result averaged for use with a single swelling characteristic determination. Alternatively, the same or different number of multiple tests may be carried out for the CEC determination and the swelling characteristic determination and the results averaged. These averaged results may then be used to develop the model of the swelling characteristic of the shale sample. The use of one or more CEC determinations and one or more swelling characteristic determinations may apply when a plurality of shale samples are used. The samples of the given shale may be obtained from a geographically proximate area or from various diverse locations.

Once the swelling characteristic and the CEC value for one or more shale samples are known at a salt concentration, the model of the swelling characteristic of the shale sample as a function of the CEC values may be determined. In an embodiment, a regression analysis of the swelling characteristic relative to the CEC values may be used to determine the model. Both linear and/or non-linear regression analyses may be used to develop the model of the swelling characteristics of a shale. Various forms of the function that may be used as the model can include, but are not limited to, a power function, an exponential function, a polynomial function, a linear function, a combination of the functions and the like. The resulting model is generally valid for the aqueous fluid (e.g., a wellbore servicing fluid) used to determine the swelling characteristics as a function of the CEC. While the model may generally be determined based on a plurality of shale samples, a model may be derived from a single shale sample if certain assumptions about the form of the resulting model are made. For example, if the model is assumed to be linear, then a single sample may be used. Alternatively, a plurality of models may be used as appropriate to determine a model comprising a plurality of empirical constants.

In an embodiment, a power function may be used to model the swelling characteristic of one or more shales based on the CEC value in a fluid with a known salt concentration. This model equation may be comprise a term of the form:

$$A_{z\,\%\,salt}=x(\mathrm{CEC})^{y} \quad \text{(Eq. 2)}$$

where $A_{z\,\%\,salt}$ is the final swelling volume of the shale in the presence of an aqueous fluid having a known salt concentration of z %, and x and y are empirical constants obtained from a regression analysis of measured values of $A_{z\,\%\,salt}$ and CEC for a range of different shales. As shown further in the accompanying examples, for various shales that are exposed to a aqueous fluid comprising of 24% NaCl the value of x(from equation 2) is expected to be between about 0 and about 20 In an embodiment, x is about 0.65. Similarly, y is expected to be between about 0 and about 6.0. In an embodiment, y is about 1.1. Using the value of x as 0.65 and y as 1.1, equation 2 may be expressed as:

$$A_{24\%\,NaCl}=0.65(\mathrm{CEC})^{1.1} \quad \text{(Eq. 3)}$$

while x and y are expected to be between the listed values, the values of x and y may vary from these values depending on the results of the regression analysis.

While the model equation may comprise only the form as shown in equation 2, additional terms may also be present in the model equation. In an embodiment, the model equation may comprise the term of the form shown in equation 2 along with additional terms and/or factors that may or may not be functions of the CEC value. For example, additional suitable model equations may comprise terms of the form:

$$A_{z\,\%\,salt}=x'(\mathrm{CEC})^{y'}+k^{*}(\mathrm{CEC}) \quad \text{(Eq. 4)}$$

or:

$$A_{z\,\%\,salt}=x''(\mathrm{CEC})^{y''} \quad \text{(Eq. 5)}$$

In an embodiment, the developed model may comprise a desired level of statistical accuracy. In order to determine the statistical accuracy of the developed model, the determined empirical constants for the chosen model may be used to produce calculated values of the final swelling volume for the one or more shale samples used to determine the model. The predicted values may be statistically compared to the measured values to provide one or more statistical measurements of the statistical accuracy of the developed model. Suitable statistical measurements may include, but are not limited to, a coefficient of determination ($R^2$), a root-mean-square-error (RMSE), a standard deviation, and/or the like. In an embodiment, the coefficient of determination for the determined model may be greater than about 0.85, greater than about 0.90, greater than about 0.92, greater than about 0.94, greater than about 0.96, or greater than about 0.98. In an embodiment, the RMSE value may be less than about 10%, less than about 7.5%, less than about 5.0%, or less than about 3% of the volume of the original shale sample(s).

Once the model has been determined, the model may be used to predict the swelling characteristics of a shale based on a determination of the CEC value of a shale sample. In an embodiment, the CEC value of a shale sample may be determined using the method used to develop the model. For example, when a methylene blue method is used to determine the CEC value or values used to develop the model, then a methylene blue method may be used to determine the CEC value of a sample of shale for use with the model. While different CEC determination methods may be used, the resulting CEC values from different CEC determination methods may vary to some degree, thereby increasing the resulting uncertainty in the swelling characteristic provided by the model. The resulting CEC value may then be used with the model to determine the corresponding swelling characteristic of the shale. Otherwise, using the similar process mentioned above, another model with different empirical constants (similar to equations 2, 4, and/or 5) may be developed for a different CEC determination method.

As discussed above, the swelling characteristics of shale may depend on both the CEC value of the shale and the salt concentration of the aqueous fluid in contact with the shale. In order to extend the applicability of the model to aqueous fluids having salt concentrations other than those used to determine the model, the model may be adjusted to take a plurality of salt concentrations in the aqueous fluid into account. The salt concentration may be taken into account using any known method, including applying a correction factor to the model to account for varying salt concentrations within the aqueous fluid. Alternatively, a plurality of separate models may be developed at desired salt concentrations, and the model having the most appropriate or closest salt concentration may be used to determine the swelling characteristics of the shale.

In an embodiment, the model may be adjusted to account for a plurality of salt concentrations. In general, the salt concentration of the aqueous fluid in contact with the shale is limited by the solubility of the particular salt in the aqueous fluid at the conditions expected during drilling and/or completion. The plurality of salt concentrations may then comprise a plurality of salt concentrations between the saturation concentration of the salt and a zero salt concentration in the aqueous fluid. In an embodiment, the plurality of salt concentrations may comprise a zero salt concentration, a saturation salt concentration at the conditions expected at the surface of the wellbore and/or the subterranean formation, and one or more additional salt concentrations between the zero concentration and the saturation concentration.

The effect of the salt concentration on the swelling characteristics of a shale sample may be determined by measuring the swelling characteristics of a shale sample at the plurality of salt concentrations. In an embodiment, the relationship of the swelling characteristics at varying salt concentrations may be expressed as:

$$A_{m\ \%\ salt}=f(m,z)A_{z\ \%\ salt} \quad \text{(Eq. 6)}$$

where $A_{m\ \%\ salt}$ is the final swelling volume of a shale in contact with an aqueous fluid having a concentration of salt of m %, $A_{z\ \%\ salt}$ is the final swelling volume of the shale in contact with an aqueous fluid having a concentration of salt of z that is either experimentally determined using the LSM test or obtained from the model (e.g., the model as described by equation 2, 4, and/or 5), and f(m,z) is a constant or function based on the concentration m of the salt in the aqueous fluid in contact with shale. As illustrated by the examples described herein, it has been discovered that the ratio of the swelling characteristics of a shale sample at a first salt concentration relative to the swelling characteristics of the shale sample at a second salt concentration is relatively independent of the shale type or source. As a result, the function f(m, z) may be a constant representing the ratio of the swelling characteristics of a shale sample at a first salt concentration relative to the swelling characteristics of the shale sample at a second salt concentration. This ratio may serve as a correction factor to the swelling predicted by the model (e.g., the model as described by equation 2, 4, and/or 5). The correction factor may then be applied to the model that is based on the CEC value of the shale to determine the swelling characteristics of the shale at a salt concentration other than the salt concentration of the fluid used to determine the model.

In an embodiment, the function f(m,z) may comprise a model derived from an analysis of the swelling characteristics of one or more shale samples at a plurality of salt concentrations. The function f(m, z), for a given base concentration z, may also be expressed as both a linear and/or a non-linear function of the variable m. Various forms of the function that may be used that include, but are not limited to, a power function, an exponential function, a polynomial function, a linear function, and the like. The swelling characteristics may be determined at salt concentrations (m %) of about 0%, about 5%, about 10%, about 15%, about 20% for NaCl and a base salt concentration (z %) of about 24% for NaCl. The salt concentrations (m %) at which the swelling characteristics may be determined and the base salt concentration (z %) may vary based on the specific salt composition being studied. The resulting ratios of the swelling characteristics of a shale sample at the test salt concentrations relative to the swelling characteristics of the shale sample at a base salt concentration ($A_{m\ \%}/A_{z\ \%}$) may then be used to obtain f(m, z) and empirically derive the best fit model for f(m, z) as a function of m for a given base concentration of z %. This best fit equation may then be used to adjust the model of the swelling characteristics of shale based on the salt concentration of an aqueous fluid of interest.

The models derived for the swelling characteristics of shale may allow for the swelling characteristics of the shale to be determined based on the CEC value and the salt concentration. A plurality of models may be derived for different salts and/or combinations of salts. The plurality of models may then be used to predict the swelling characteristics of a shale by selecting the model for the appropriate salt or salt mixture. Alternatively, the closest representative model may be used to estimate the swelling characteristics of a shale when the wellbore servicing fluid contains a salt and/or salt mixture for which a model has not been derived. This method may allow for the swelling characteristics of a shale to be determined for a variety of salt and salt mixtures.

The swelling characteristic information can then be used in various ways during the drilling and/or completion of a wellbore such as determining the composition of a wellbore servicing fluid, water-based drilling fluid, determining the composition of a completion fluid, determining the composition of a water-based workover fluid (e.g., a fracturing fluid), determining the drilling parameters for a drilling process, adjusting the drilling parameters for a drilling process upon entering a new shale zone, adjusting the drilling parameters to address an operational issue during drilling and/or completion, and/or using the information to detect and correct for an potential operational problem during drilling and/or completion.

In an embodiment, the swelling characteristic information provided by the model described herein may be used to determine and/or adjust a composition of a wellbore servicing fluid (e.g., a drilling fluid and/or a completion fluid) used to drill a wellbore. In this embodiment, the CEC of a sample of shale from a subterranean formation may be determined and used in a model of the swelling characteristics of the shale, which may be derived according to any of the methods described herein. A swelling characteristic of the shale may then be determined from the model, which may comprise a term of the form:

$$A_{z\ \%\ salt}=x(\text{cation exchange capacity})^{y}$$

where $A_{z\ \%\ salt}$ is a final swelling volume of the shale in the presence of an aqueous fluid having a salt concentration of z %, and x and y are empirical constants.

Once the swelling characteristic is determined, the information may then be used to determine a composition of a wellbore servicing fluid being used to drill and/or complete the wellbore. As described herein, a wellbore servicing fluid may comprise numerous components including one or more salts and a variety of additives. In an embodiment, the swelling characteristic may be used to determine the salt concentration for a wellbore servicing fluid. In this embodiment, the model may be used to predict the swelling characteristic of a shale at various salt concentrations. If a swelling threshold is specified or known, then the model may be used to determine a salt concentration or range of salt concentrations at which the swelling characteristic of the shale can be maintained within a selected and/or allowable range (e.g., below the threshold). Alternatively or in addition to the salt concentration in the wellbore servicing fluid, the swelling characteristic may be used to determine the amount and type of additional additive useful in the wellbore servicing fluid. For example, if the predicted swelling characteristic indicates that some sloughing of the shale may occur and result in an altered rheological property of the wellbore servicing fluid, then the use and amount of one or more additives (e.g., shale stabilizers, flocculants, viscosifiers, and the like) may be determined. Once the wellbore servicing fluid composition has been determined, the wellbore may be drilled and/or completed using the wellbore servicing fluid.

In an embodiment, the swelling characteristic information provided by the model described herein may be used to determine and/or adjust a composition of a wellbore servicing fluid such as a fracturing fluid. In this embodiment, the CEC of a sample of shale from a subterranean formation may be determined and used in a model of the swelling characteristics of the shale, which may be derived according to any of the methods described herein. A swelling characteristic of the shale may then be determined from the model, which may comprise a term of the form:

$$A_{z\ \%\ salt}=x(\text{cation exchange capacity})^{y}$$

where $A_{z\ \%\ salt}$ is a final swelling volume of the shale in the presence of an aqueous fluid having a salt concentration of z %, and x and y are empirical constants.

Once the swelling characteristic is determined, the information may then be used to determine a composition of a workover fluid and/or a completion fluid being used in the performance of a workover procedure. In an embodiment, a workover procedure can include a production enhancement procedure such as a fracturing operation. As described herein, a water-based fluid may comprise numerous components including one or more salts and a variety of additives. In an embodiment, the swelling characteristic may be used to determine the salt concentration for a workover fluid. In this embodiment, the model may be used to predict the swelling characteristic of a shale at various salt concentrations. If a swelling threshold is specified or known, then the model may be used to determine a salt concentration or range of salt concentrations at which the swelling characteristic of the shale can be maintained within a selected and/or allowable range (e.g., below the threshold). The swelling characteristics may be used to reduce the formation damage during a workover procedure. In an embodiment, some amount of formation damage may be acceptable in order to carry out the workover procedure. For example, some amount of formation damage may be acceptable during a fracturing operation in order to achieve a desired degree and extent of fracturing. In this embodiment, the swelling characteristics may be used to determine the fluid composition that will produce an acceptable level of formation damage. Alternatively or in addition to the salt concentration in the workover fluid, the swelling characteristic may be used to determine the amount and type of additional additive useful in the workover fluid. For example, if the predicted swelling characteristic indicates that some sloughing of the shale or formation damage may occur during the workover procedure and result in an altered rheological property of the workover fluid, then the use and amount of one or more additives (e.g., shale stabilizers, flocculants, viscosifiers, and the like) may be determined. Once the workover fluid composition has been determined, the workover fluid may be used in the performance of the workover procedure.

In another embodiment, the swelling characteristic information provided by the model described herein may be used to adjust a salt concentration of a water-based drilling fluid used to drill a wellbore. In this embodiment, a first portion of a wellbore may be drilled through a subterranean formation comprising a shale using a first drilling fluid. A salt concentration of the first drilling fluid may be adjusted based on a swelling characteristic of the shale to produce a second drilling fluid. The swelling characteristic of the shale may be determined using the CEC of the shale as measured using any of the methods disclosed herein in a model for the swelling characteristics of the shale. In this embodiment, the model for the swelling characteristic may account for both the CEC of the shale and the salt concentration of the fluid in contact with the shale. The salt concentration may be selected to maintain the swelling characteristic below a certain value or threshold. As described herein, both the salt concentration and the salt composition may affect the swelling characteristic of a shale. As a result, one or more models may be used to select both a salt concentration and/or a salt composition (e.g., a particular salt or combination of salts) for use with the drilling fluid. A second portion of the wellbore may then be drilled using the second drilling fluid.

In an embodiment, the swelling characteristic information can be used to address an operational issue during drilling. In this embodiment, the drilling of a wellbore in a subterranean formation comprising a shale may cease in response to encountering an operational issue. Various operational issues may be encountered while drilling through shales such as sloughing of the shale, a tight hole, bore hole collapse, stuck-pipe, stuck collars, gumbo attacks, poor hole cleaning, poor logging and cementing conditions, difficulty returning a drilling and/or production assembly to the bottom of the wellbore, and/or disintegration of the shale that can lead to an increase in the concentration fines, a change in the rheological properties, and the rate of penetration. Upon encountering an operation issue while drilling through a subterranean formation comprising a shale, the swelling characteristics of the shale may be determined based on the CEC value of the shale and/or the salt concentration in the aqueous fluid and the model(s) for the swelling characteristics as disclosed herein. A solution to the operational issue may then be determined based on the swelling characteristic determined using the CEC value and the model. For example, if the swelling characteristics of the shale can be altered or controlled by changing or adjusting the composition of a drilling fluid as described above, then the drilling fluid composition may be changed to address the operational issue. In some instances, the swelling characteristic model may indicate that a change to the composition of the drilling fluid may not adequately address the operational issue. In this case, the solution to an operational issue such as shale sloughing or a potential or actual bore hole collapse may comprise setting casing or a liner through at least a portion of the wellbore. As another example, the solution to a stuck pipe or gumbo attack may comprise retrieving the drill string from the wellbore, repairing, replacing, or altering the makeup of the drill string, and replacing the drill string in the wellbore. This may be performed in addition to altering the drilling fluid composition. Once the solution to the operational issue has been determined and applied, the drilling of the wellbore may be continued.

In an embodiment, the swelling characteristic information can be used to detect and correct for a potential operational issue during drilling. In this embodiment, at least one parameter of a drilling process may be measured while drilling a wellbore in a subterranean formation comprising a shale. As described in more detail herein, various instruments, sensors, and/or logging tools may be used during the drilling process to detect and/or measure various parameters of the subterranean formation, the drill string, and/or the drilling equipment. For example, the parameters that may be measured during the drilling process may include, but are not limited to, the weight-on-bit, the torque-on-bit, the rate-of-penetration, the temperature in the wellbore, the pressure near the bit, the torque on the drill string, the power output of any motors and/or pumps located at the surface of the wellbore, and/or one or more logging measurements. When at least one of the measured parameters exceeds one or more thresholds, a swelling characteristic of the shale may be determined based on the CEC of the shale at a known salt concentration in the aqueous fluid. Various thresholds may be used to indicate a potential operational issue, and/or an actual operational issue.

For example, when the torque-on-bit exceeds a threshold and/or a rate-of-penetration drops below a threshold, it may be a sign that excessive swelling of a shale has the potential to create or has already created an operational issue. In response to the at least one measured parameter exceeding the threshold, the composition of a wellbore servicing fluid (e.g., a drilling fluid) may be modified based on the determined swelling characteristic. The drilling of the wellbore may then be continued using the wellbore servicing fluid having the modified composition.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

Example 1

Figure 2:
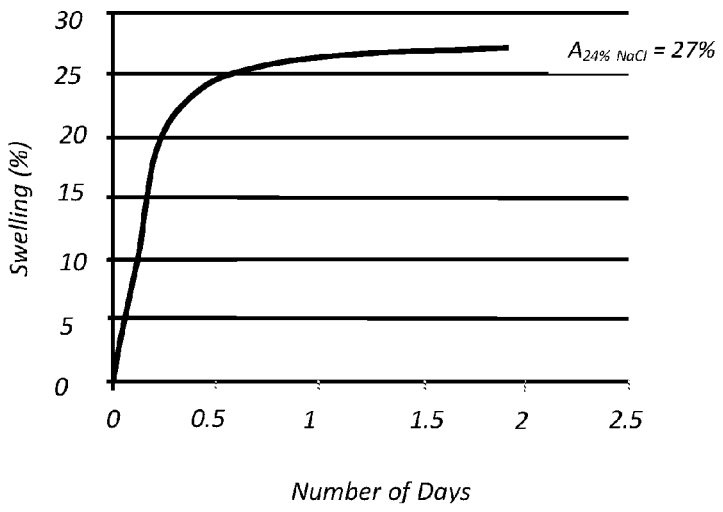
FIG. 2 is a graph showing the swelling behavior of a shale in the presence of an aqueous fluid according to an embodiment.

In this example, the swelling characteristics of a sample of an outcrop/shale (London clay) were determined using the LSM method as described herein. Specifically, a sample of the London clay was dried and ground to a particle size small enough to pass through a 200-mesh screen (based on the U.S. mesh scale). The ground and screened sample was homogenized with a measured amount of water to form a sample with about 5% water by weight and placed in a cylindrical SS (stainless steel) mold. A compacting pressure of about 10,000 psi was applied and maintained for about 1.5 hours. The resulting compacted shale sample was then equilibrated in a predetermined constant relative humidity environment of about 29% to about 35% relative humidity using a desiccator containing a saturated calcium chloride brine solution. The sample core was then maintained in the desiccator to equilibrate for about 72 hours. The properties of the sample including the sample core length, the sample core diameter, the sample core weight, the compaction data, and the equilibrium humidity were then recorded. The sample core was then placed in a LSM test apparatus as described above. In this test, the sample core length was measured using a caliper and the sample core was weighed upon being removed from the desiccator. The core sample was then wrapped with a 60-mesh retaining screen along with a displacement sensor and the resulting assembly was placed in a temperature controlled container (i.e., a heat cup). The displacement sensor was used to take an initial displacement reading and then the assembly was exposed to a water-based drilling fluid have a sodium chloride content of about 24% by weight at about 150° F. The swelling of the sample core was measured by recording the axial position of the displacement sensor within the porous sleeve for a period of approximately 2-3 days until the swelling curve reaches a plateau. The results of the swelling behavior of the London clay sample are shown in FIG. 2. It can be seen from the results that after a period of approximately 1 day, the rate of swelling decreased as the sample approached its final swelling volume. The final swelling volume as measured at 2 days was an approximately 27% volume increase from the original London clay sample.

Example 2

In this example, a model for the swelling volume of shale was developed based on the CEC value of the shale. In order to develop the model, fourteen different shale samples were tested according to the same experimental procedure as described above in Example 1. The identification of the shale samples and the resulting swelling volumes are shown in Table 1.

In addition to the LSM test, additional portions of each shale sample were tested to determine the CEC value. The methylene blue method (API Recommended Practice, 13 B (IV Ed., March 2009)) was used to determine the CEC value of each sample. Specifically, an approximately 1 gram dried and ground shale sample (ground to about a 200-mesh screen) was added to a flask containing 25 milliliters (ml) of a 2% tetrasodium pyrophoshpate solution. The mixture was boiled for about 10 minutes and 15 ml of a hydrogen peroxide solution were added. To this mixture, 1 ml of a 5 N sulphuric acid solution was added. The resulting mixture was boiled for about 10 minutes. After boiling, the mixture was diluted with 50 ml of distilled water and allowed to cool. The resulting slurry was then titrated using 0.5 ml methylene blue solution (3.74 g/L to give 1 ml=0.01 meq) while being agitated. A drop of the mixture was placed on filter paper to check for the appearance of a blue halo around the drop on the filter paper. The titration process was repeated with the increment of 0.5 ml of methylene blue solution until a blue halo appeared on the filter paper. The blue halo indicates the excess of the methylene blue beyond the saturation point, which serves to denote the saturation point of the shale sample. The concentration and volume of the methylene blue titration solution was used along with the weight of the shale sample to determine the CEC of the shale sample. The resulting CEC values of each shale sample are shown in Table 1.

TABLE 1

Experimental Results for $A_{24\%\ NaCl}$ and CEC values for 14 Shale Samples

| Shale Type | CEC (meq/100 g) | Expt_$A_{24\%\ NaCl}$ (%) |
|---|---|---|
| London clay | 24 | 27 |
| Pierre shale I | 14.5 | 8 |
| Pierre shale II | 24 | 25 |
| Bentonite I | 48 | 47.8 |
| Bentonite II | 60 | 56.7 |
| Morrow shale | 14 | 13 |
| Mancos shale | 4 | 0.3 |
| Sotts Lycoming shale | 5 | 5 |
| Shale sample A | 23.4 | 18.8 |
| Shale sample B | 12.1 | 11.8 |
| Shale sample C | 22 | 22 |
| Shale sample D | 22.5 | 20.9 |
| Shale sample E | 9 | 2.7 |
| Shale sample F | 16 | 19 |

The experimentally obtained values as shown in Table 1 were used to perform a regression analysis based on a model having the form shown in equation 2 ($A_{z\ \%\ salt}=x(CEC)^y$) The regression analysis resulted in the determination of a value for x of 0.65 and a value for y of 1.1. Thus, the resulting equation for the swelling characteristic (e.g., the final swelling volume) of the shales based on the CEC values was represented by the formula:

$$A_{24\%\ NaCl}=0.65(CEC)^{1.1}$$

Figure 3:
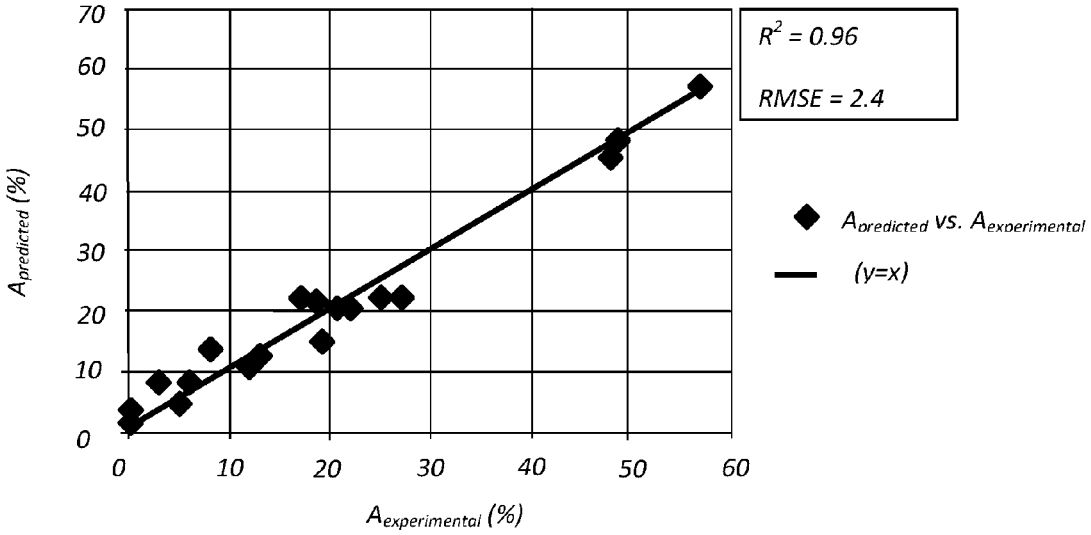
FIG. 3 is a graph showing the predicted swelling volumes of several shale samples relative to the measured swelling volumes of the same shale samples according to an embodiment.

In order to demonstrate the statistical accuracy of the developed model, the empirical constants were used along with the model to produce calculated values of the final swelling volume at 24% NaCl ($A_{24\%\ NaCl}$) for the 14 shales studied. The predicted values of $A_{24\%\ NaCl}$ and the experimental values were plotted together as shown in FIG. 3. The results show that the coefficient of determination ($R^2$) value is approximately 0.96 and the Root-mean-square-error (RMSE) was approximately 2.4.

In order to further validate the developed model, four unknown shales (not used for the regression analysis) were chosen as shown in Table 2. The final swelling volumes (A) were predicted using the model and CEC values. As shown in Table 2, the predicted values of $A_{24\%\ NaCl}$ and the experimental values show an excellent match for the four unknown shale samples (RMSE≈2.3). Thus, for the shales studied, the use of the equation of the form shown in equation 2 represents a good fit for the model of the swelling volumes based on the CEC values at a given salt composition and concentration.

TABLE 2

Experimental $A_{24\%\ NaCl}$ vs. predicted $A_{24\%\ NaCl}$ for four unknown shales

| Shale Type | CEC (meq/100 g) | Expt_$A_{24\%\ NaCl}$(%) | Predicted_$A_{24\%\ NaCl}$(%) |
|---|---|---|---|
| Shale sample G | 50.8 | 48.3 | 48.9 |
| Shale sample H | 9 | 5.9 | 7.2 |
| Shale sample I | 1.5 | 0.2 | 1.0 |
| Shale sample J | 24 | 17 | 21.4 |

Example 3

Figure 4:
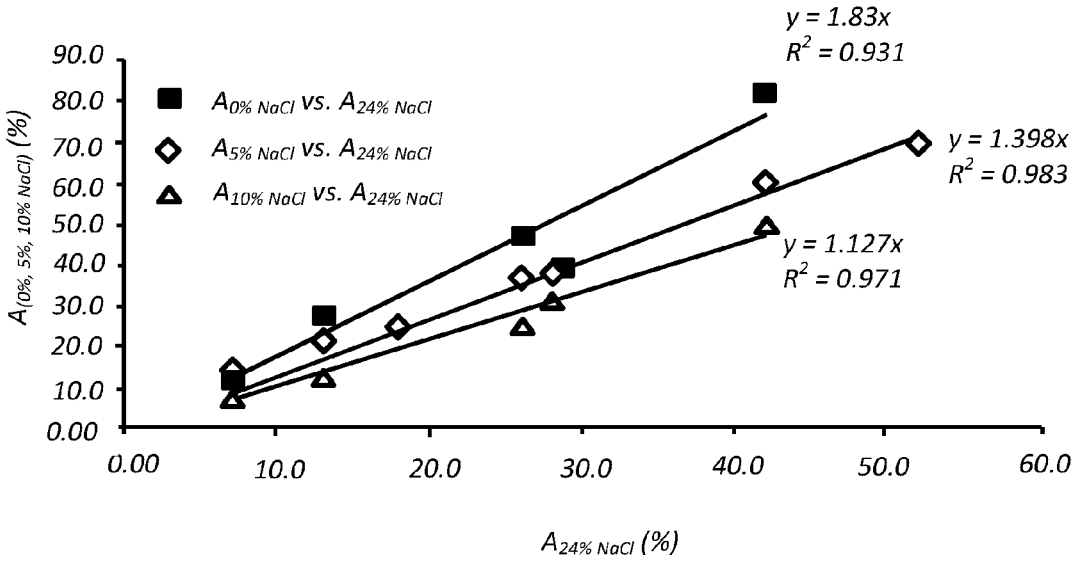
FIG. 4 is a graph showing the swelling volumes of five shale samples in contact with aqueous solutions have varying salt concentrations relative to the swelling volumes of the five shale samples in contact with an aqueous solution having a reference salt concentration according to an embodiment.

In this example, the effect of varying salt concentration on the swelling characteristics of a shale and the derived model were tested. Five shales were tested using the LSM test as described above in Example 1 using a water-based drilling fluid having sodium chloride concentrations of 0%, 5%, and 10%. The samples included those identified as London clay, Pierre shale II, Bentonite I, Pierre shale I, and Morrow shale. The final swelling results obtained from these tests were then analyzed relative to the final swelling volumes of the same shales in the presence of a water-based drilling fluid having a sodium chloride concentration of approximately z %=24%. The results are shown in FIG. 4. A linear relationship was determined for each swelling volume based on each test concentration (0% NaCl, 5% NaCl, and 10% NaCl) relative to the base salt concentration (24% NaCl) used to develop the original swelling characteristics model as described in Example 2. The resulting equations are:

$$\text{For } A_{0\%\ NaCl} \text{ vs. } A_{24\%\ NaCl}: A_{0\%\ NaCl} = 1.83\, A_{24\%\ NaCl} \quad \text{(Eq. 7)}$$

$$\text{For } A_{5\%\ NaCl} \text{ vs. } A_{24\%\ NaCl}: A_{5\%\ NaCl} = 1.398\, A_{24\%\ NaCl} \quad \text{(Eq. 8)}$$

$$\text{For } A_{10\%\ NaCl} \text{ vs. } A_{24\%\ NaCl}: A_{10\%\ NaCl} = 1.127\, A_{24\%\ NaCl} \quad \text{(Eq. 9)}$$

Figure 5:
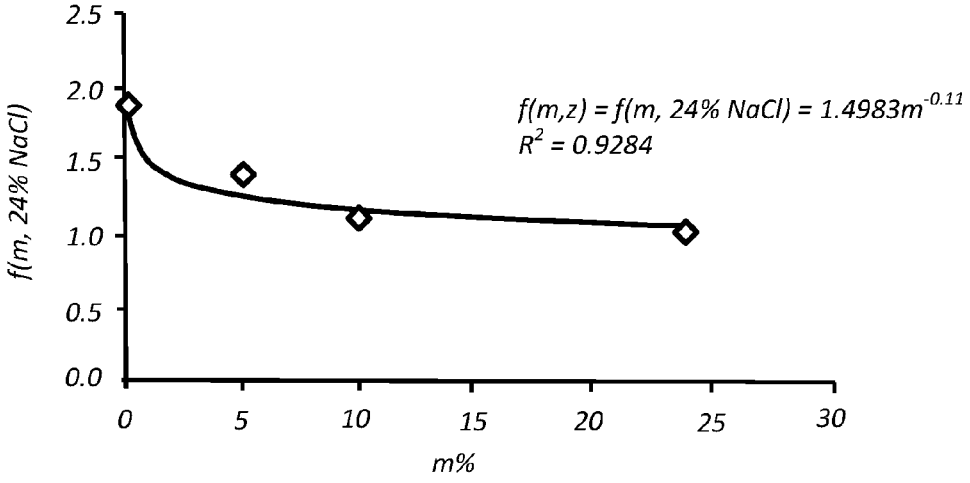
FIG. 5 is a graph showing a relationship between the ratio of the swelling characteristics at a salt concentrations to that at base concentration relative to the chosen salt concentration according to an embodiment.

The results indicated that the linear relationship for each sodium chloride concentration relative to the base sodium chloride concentration is a good fit for all of the shales tested. This result indicates that the resulting relationship between the salt concentrations is substantially independent of shale chemistry. Equations 7-9 may then provide the basis for estimating the swelling characteristics of a shale at a concentration of sodium chloride other than the concentration initially used to develop the CEC-based model as indicated in Eq. 6. As the test concentration (m) varies as 0%, 5% and 10%, correspondingly, the values of concentration dependent slopes, f(m,z) or f(m,24% NaCl), change from 1.83, 1.398 to 1.127 as shown in Equations 7-9. As shown in FIG. 5, a relation between f(m, 24% NaCl) and m may be developed that may be expressed as linear and/or non-linear function of the variable m.; this relation may be used to correct for a different salt concentration.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l-k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of servicing a wellbore comprising:

determining a cation exchange capacity of a sample of a shale;

determining a swelling characteristic of the shale using the cation exchange capacity in an equation comprising a term of the form:

$$A_{z\%\ salt} = x(\text{cation exchange capacity})^y$$

where $A_{z\%\ salt}$ is a final swelling volume of the shale in the presence of an aqueous fluid having a salt concentration of z %, and x and y are empirical constants, wherein x and y are determined base on an analysis of at least one measured final swelling volume value and at least one measured CEC value of at least one shale sample, wherein the at least one measured final swelling volume value of the at least one shale sample is determined in the presence of a sample fluid having the salt concentration of z %;

determining a composition of a wellbore servicing fluid based on the determined swelling characteristic; and drilling the wellbore using the wellbore servicing fluid.

2. The method of claim 1, wherein the shale comprises a clay, and wherein the clay comprises a smectite clay, an illite clay, a mixed smectite-illite clay, a chlorite clay, a corrensite clay, a kaolinite clay, or any combination thereof.

3. The method of claim 1, wherein the wellbore servicing fluid is a water-based wellbore servicing fluid that comprises an aqueous fluid.

4. The method of claim 3, wherein the wellbore servicing fluid further comprises at least one salt.

5. The method of claim 3, wherein the wellbore servicing fluid further comprises one or more additives selected from the group consisting of: an emulsifier, a viscosifier, an emulsion destabilizer, an antifreeze agent, a biocide, an algaecide, a pH control additive, an oxygen scavenger, a clay stabilizer, a weighting agent, a degradable fluid loss agent, a foaming agent, a foaming fluid, and any combination thereof.

6. The method of claim 1, wherein determining the cation exchange capacity of the sample comprises performing a test using a methylene blue method, an ammonium acetate method, a benzyl ammonium chloride method, a malachite green method, or a silver-thiourea method.

7. The method of claim 1, wherein x is a value in the range of about 0 and about 20, and y is a value in the range of about 0 and about 6.

8. The method of claim 1, wherein x is about 0.65 and y is about 1.1 when the z % salt concentration is about 24% sodium chloride.

9. The method of claim 1, wherein determining the composition of the wellbore servicing fluid comprises selecting one or more components of the wellbore servicing fluid to maintain the swelling characteristic of the shale within a selected range.

10. The method of claim 1, further comprising:

drilling a first portion of the wellbore through a subterranean formation using a drilling fluid, wherein the subterranean formation comprises the shale;

wherein determining the composition of the wellbore servicing fluid comprises adjusting a concentration of a salt in the drilling fluid to produce the wellbore servicing fluid based on the determined swelling characteristic of the shale; and wherein drilling the wellbore using the wellbore servicing fluid comprises drilling a second portion of the wellbore using the wellbore servicing fluid.

11. The method of claim 10, wherein the salt comprises at least one compound selected from the group consisting of: sodium chloride (NaCl), potassium chloride (KCl), calcium chloride (CaCl2), a magnesium salt, a bromide salt, a formate salt, an acetate salt, a nitrate salt, and any combination thereof.

12. The method of claim 10, wherein the cation exchange capacity of the shale is determined using a methylene blue method, an ammonium acetate method, a benzyl ammonium chloride method, a malachite green method, or a silver-thiourea method.

13. The method of claim 10, wherein the swelling characteristic of the shale is determined using the cation exchange capacity of the shale and a salt concentration in an equation comprising a term of the form:

$$A_{m\ \%\ salt}=f(m,z)*(x)(\text{cation exchange capacity})^{y}$$

where $A_{m\ \%\ salt}$ is a final swelling volume of the shale in contact with an aqueous fluid having a salt concentration of m %, and f(m,z) is a function based on the salt concentration of m % relative to the salt concentration of z %.

14. The method of claim 10, wherein adjusting the concentration of the salt in the drilling fluid comprises adjusting the concentration of the salt in an aqueous fluid; and maintaining the swelling characteristic of the shale within a selected range based on adjusting the concentration of the sale in the aqueous fluid.

15. The method of claim 10, wherein adjusting the concentration of the salt in the drilling fluid comprises selecting a composition of the salt; and maintaining the swelling characteristic of the shale within a selected range based on selecting the composition of the salt.

16. The method of claim 1, further comprising:

drilling a first portion of the wellbore in a subterranean formation comprising the shale;

ceasing the drilling in response to encountering an operational issue;

determining a solution to the operational issue based on the swelling characteristic of the shale; and wherein drilling the wellbore using the wellbore servicing fluid comprises: continuing the drilling using the wellbore servicing fluid in response to applying the solution to the operational issue.

17. The method of claim 1, further comprising:

measuring at least one parameter of a drilling process while drilling the wellbore in a subterranean formation comprising the shale; wherein determining a swelling characteristic of the shale occurs in response to the at least one parameter exceeding a threshold, wherein the swelling characteristic is determined based on a cation exchange capacity of the shale and a concentration of salt in a drilling fluid;

wherein determining the composition of the wellbore servicing fluid comprises modifying a composition of the drilling fluid based on the determined swelling characteristic; and wherein drilling the wellbore using the wellbore servicing fluid comprises continuing to drill the wellbore using the wellbore servicing fluid having the modified composition.

18. The method of claim 1, wherein the at least one measured final swelling volume value of the at least one shale sample is determined using at least one of a linear swell meter test, a capillary suction test, or a hardness test.

* * * * *